US010247403B2

(12) United States Patent
Kim

(10) Patent No.: US 10,247,403 B2
(45) Date of Patent: Apr. 2, 2019

(54) HEAT SINK AND LIGHTING APPARATUS

(71) Applicant: LG INNOTEK CO., LTD., Seoul (KR)

(72) Inventor: Ji Hoon Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/101,100

(22) PCT Filed: Dec. 2, 2014

(86) PCT No.: PCT/KR2014/011684
§ 371 (c)(1),
(2) Date: Jun. 2, 2016

(87) PCT Pub. No.: WO2015/084015
PCT Pub. Date: Jun. 11, 2015

(65) Prior Publication Data

US 2017/0030568 A1 Feb. 2, 2017

(30) Foreign Application Priority Data

Dec. 2, 2013 (KR) ..... 10-2013-0148507

(51) Int. Cl.
*F21V 29/71* (2015.01)
*F21V 29/70* (2015.01)
(Continued)

(52) U.S. Cl.
CPC ..... *F21V 29/70* (2015.01); *F21S 45/47* (2018.01); *F21V 3/00* (2013.01); *F21V 29/507* (2015.01);
(Continued)

(58) Field of Classification Search
CPC ..... F21V 29/507; F21V 29/89; F21V 29/90; F21V 29/75; F21V 29/76; F21V 29/763;
(Continued)

(56) References Cited

U.S. PATENT DOCUMENTS 7,114,837 B2 10/2006 Yagi et al.
8,342,714 B1 * 1/2013 Rea ..... F21V 11/183 362/264
(Continued)

FOREIGN PATENT DOCUMENTS

CN 1536264 10/2004
CN 101368714 2/2009
(Continued)

OTHER PUBLICATIONS

PCT International Search Report dated Mar. 31, 2015 issued in Application No. PCT/KR2014/011684 (with English Translation).
(Continued)

*Primary Examiner* — Zheng Song
(74) *Attorney, Agent, or Firm* — Ked & Associates, LLP

(57) ABSTRACT

The present invention relates to a heat sink and a lighting apparatus, and the heat sink, according to one embodiment of the present invention, comprises: a heat transfer module for transferring heat generated from a light source module; and a housing including the light source module and a heat sink module for radiating the heat transferred from the heat transfer module.

11 Claims, 2 Drawing Sheets

(51) Int. Cl.

| | |
|---|---|
| ***F21V 29/87*** | (2015.01) |
| ***F21V 3/00*** | (2015.01) |
| ***F21V 29/507*** | (2015.01) |
| ***F21S 45/47*** | (2018.01) |
| *F21V 29/89* | (2015.01) |
| *F21Y 115/10* | (2016.01) |
| *F21W 131/40* | (2006.01) |
| *F21V 29/90* | (2015.01) |
| *F21S 41/141* | (2018.01) |

(52) U.S. Cl.
CPC ..... *F21V 29/87* (2015.01); *F21S 41/141* (2018.01); *F21V 29/71* (2015.01); *F21V 29/89* (2015.01); *F21V 29/90* (2015.01); *F21W 2131/40* (2013.01); *F21Y 2115/10* (2016.08)

(58) Field of Classification Search
CPC ..... F21V 29/767; F21V 29/777; F21V 29/70; F21V 29/71; F21V 29/773; F21V 15/013; F21S 48/321; F21S 48/328; F21S 45/47; F21S 41/141; F21Y 2115/10; F21W 2131/40
See application file for complete search history.

(56) References Cited

U.S. PATENT DOCUMENTS

| | | | | |
|---|---|---|---|---|
| 8,419,250 | B2 | 4/2013 | Ohsawa | |
| 2008/0112170 | A1* | 5/2008 | Trott | F21S 8/02 362/311.06 |
| 2009/0059594 | A1* | 3/2009 | Lin | F21K 9/00 362/294 |
| 2010/0103689 | A1* | 4/2010 | Lee | F21S 48/1154 362/487 |
| 2010/0103691 | A1* | 4/2010 | Yasuda | F21S 48/1159 362/547 |
| 2010/0214777 | A1* | 8/2010 | Suehiro | F21V 7/005 362/235 |
| 2010/0315830 | A1* | 12/2010 | Wan | F21S 48/1159 362/547 |
| 2012/0188762 | A1* | 7/2012 | Joung | F21V 15/01 362/235 |
| 2012/0250333 | A1* | 10/2012 | Chou | F21V 29/004 362/351 |
| 2012/0300486 | A1* | 11/2012 | Matsushita | G02B 27/01 362/521 |

FOREIGN PATENT DOCUMENTS

| | | | |
|---|---|---|---|
| CN | 201209839 | | 3/2009 |
| CN | 101861494 | | 10/2010 |
| EP | 2 312 204 | A1 | 4/2011 |
| JP | 2007-087665 | A | 4/2007 |
| JP | 2008-293692 | A | 12/2008 |
| JP | 2009-266572 | A | 12/2009 |
| KR | 20-0417462 | Y1 | 5/2006 |
| KR | 10-2009-0029123 | A | 3/2009 |
| KR | 10-2011-0021228 | A | 4/2011 |
| KR | 10-1052131 | B1 | 7/2011 |
| KR | 2013-0067500 | A | 6/2013 |
| KR | 2013-0074385 | A | 7/2013 |

OTHER PUBLICATIONS

Chinese Office Action dated Jul. 24, 2018 issued in Application No. 201480071484.7 (English translation attached).

* cited by examiner

[Fig. 1]
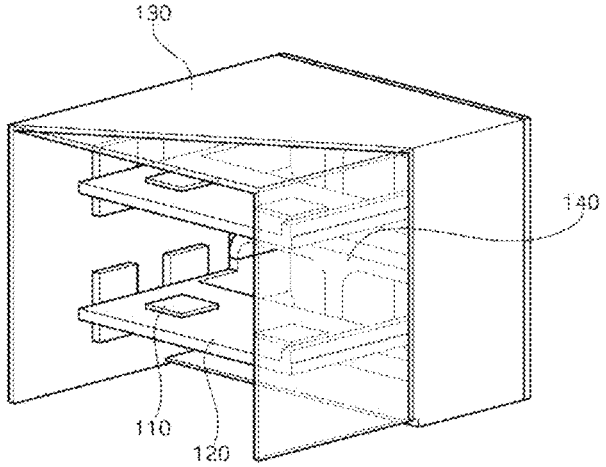
[Fig. 2]
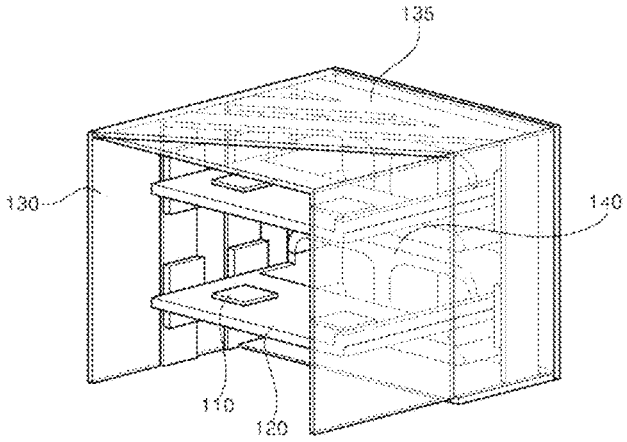
[Fig. 3]
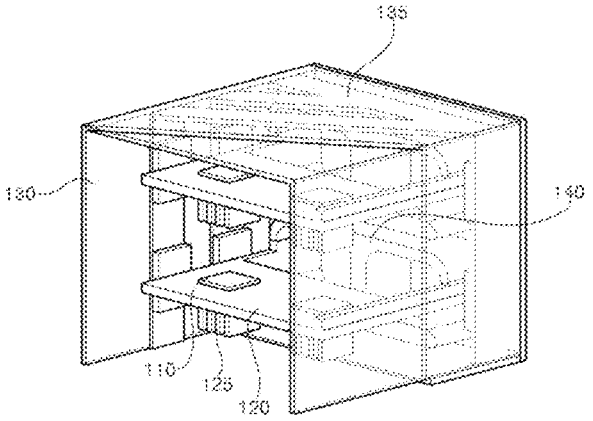

[Fig. 5]
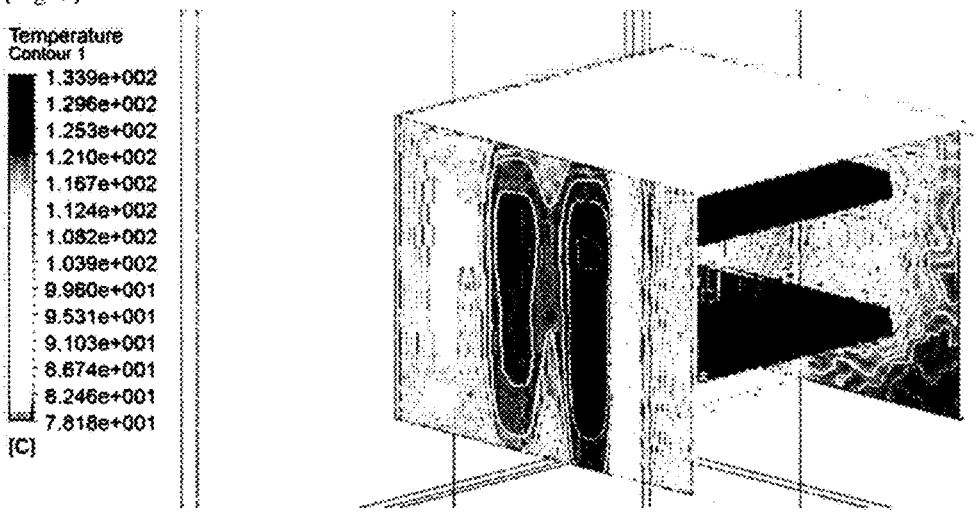
[Fig. 4]
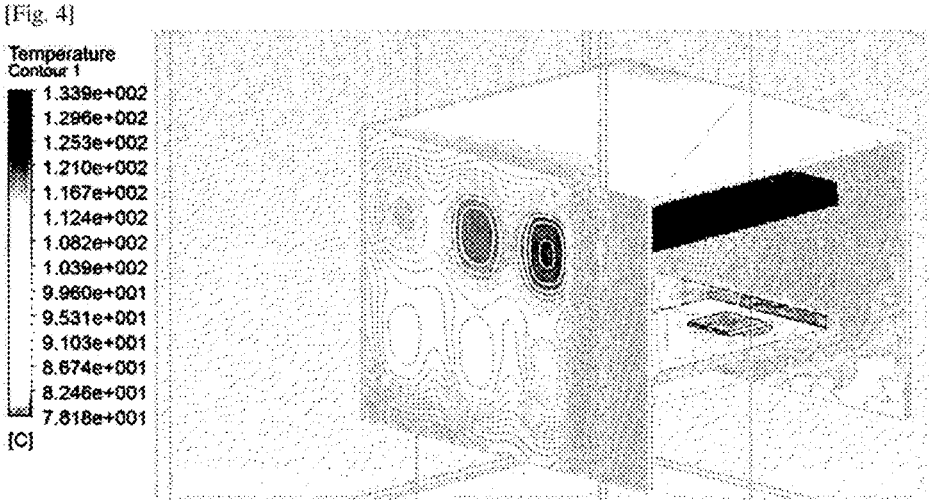

HEAT SINK AND LIGHTING APPARATUS

CROSS-REFERENCE TO RELATED PATENT APPLICATIONS

This application is a U.S. National Stage Application under 35 U.S.C. § 371 of PCT Application No. PCT/PCT/KR2014/011684, filed Dec. 2, 2014, which claims priority to Korean Patent Application No. 10-2013-0148507, filed Dec. 2, 2013, whose entire disclosures are hereby incorporated by reference.

TECHNICAL FIELD

Embodiments of the present invention relate to a heat radiation apparatus and a lighting apparatus.

BACKGROUND ART

A light emitting diode (LED) device converts an electrical signal into infrared rays or light using a compound semiconductor property, does not use harmful substance such as mercury unlike a fluorescent light to hardly cause environmental contamination, and has a long life span as compared to a conventional light source. In addition, the LED device has low power consumption, excellent visibility due to a high color temperature and low glare effect as compared to the conventional light source and, recently, is widely used as a light source of a vehicle headlamp.

However, a basic environmental temperature of a vehicle headlamp is close to 80° C. due to engine heat. Since the vehicle headlamp is sealed and has low heat radiation property, internal temperature increase has an influence on the life span of the LED. Accordingly, a high-performance heat radiation system capable of efficiently radiating heat generated in an LED is required and thus a fan for heat radiation of the LED is employed.

Conventionally, a heat radiation structure for a vehicle headlamp includes an LED module formed inside a headlamp housing, a heat sink formed on the bottom of the LED module, and a cooling fan provided under the heat sink.

That is, the conventional heat radiation structure for vehicle headlamps radiates heat generated in the LED module through the heat sink formed on the bottom of the LED module and cools the heat sink through the cooling fan, thereby increasing heat radiation efficiency.

However, when a separate cooling fan is mounted in the conventional heat radiation structure for vehicle headlamps, cost and the weight of a vehicle increase and space utilization decreases. In addition, when the cooling fan is used for a long time, the cooling fan overheats and hot wind is generated, thereby decreasing cooling effect.

In addition, the life span of the LED and the life span of the cooling fan may decrease and an electric motor may be applied to the LED headlamp with low power.

DISCLOSURE

Technical Problem

The present invention is proposed to solve the above-described problems. Embodiments of the present invention more efficiently radiate heat generated in a light source module through a heat radiation module inserted into a housing.

In addition, the embodiments of the present invention efficiently perform cooling without using a separate cooling device such as a cooling fan.

In addition, the embodiments of the present invention provide a heat radiation apparatus for implementing a snow melting effect when used for a vehicle lighting apparatus, and a lighting apparatus.

Technical Solution

A heat radiation apparatus according to an embodiment for solving the above-described problems includes a heat transfer module for transferring heat generated in light source modules and a housing including a heat radiation module for radiating heat delivered from the light source modules and the heat transfer module.

According to another embodiment of the present invention, the heat radiation module may be attached to a wall of the housing.

According to another embodiment of the present invention, the heat radiation module may be embedded in a wall of the housing.

According to another embodiment of the present invention, the housing may be made of a thermally conductive polymer material.

According to another embodiment of the present invention, the heat radiation module may include a first heat radiation portion having a bar shape and a second heat radiation portion connected to the first heat radiation portion and having a bar shape.

According to another embodiment of the present invention, a plurality of second heat radiation portions may be included.

According to another embodiment of the present invention, the second heat radiation portion may be arranged in a direction different from an arrangement direction of the first heat radiation portion.

According to another embodiment of the present invention, the heat radiation module may be made of a metal material According to another embodiment of the present invention, the light source modules may be provided on the heat transfer module.

According to another embodiment of the present invention, the heat radiation apparatus may further include heat sinks provided on a surface opposite to a surface, on which the light source modules are provided, of the heat transfer module.

According to another embodiment of the present invention, the heat sinks may be provided to respectively correspond to the light source modules.

According to another embodiment of the present invention, the heat transfer module may be made of an aluminum material.

According to another embodiment of the present invention, the heat transfer module may be provided to traverse the inside of the housing.

According to another embodiment of the present invention, a plurality of heat radiation modules may be provided in the housing.

A lighting apparatus according to an embodiment of the present invention includes the heat radiation apparatus according to any one of the embodiments, a lens for diffusing light from the light source modules, and a lens fixing unit for fixing the lens for diffusing light from the light source modules.

Advantageous Effects

According to the embodiment of the present invention, it is possible to more efficiently radiate heat generated in a light source module through a heat radiation module inserted into a housing.

In addition, according to the embodiment of the present invention, it is possible to efficiently perform cooling without using a separate cooling device such as a cooling fan.

In addition, according to the embodiment of the present invention, it is possible to provide a heat radiation apparatus for implementing a snow melting effect when used for a vehicle lighting apparatus, and a lighting apparatus.

DESCRIPTION OF DRAWINGS

FIGS. 1 and 2 are views illustrating a heat radiation apparatus according to an embodiment of the present invention;

FIG. 3 is a view illustrating a heat radiation apparatus according to another embodiment of the present invention; and FIGS. 4 and 5 are views illustrating heat radiation performance of a heat radiation apparatus according to an embodiment of the present invention.

BEST MODE

Hereinafter, the embodiments of the present invention will be described in detail with reference to the accompanying drawings so as to be easily implemented by those skilled in the art. Those skilled in the art will appreciate that the embodiments disclosed in this specification and the configurations shown in the drawings are merely exemplary and various equivalents and modifications are possible.

In describing the principles of the preferred embodiments of the present invention in detail, if it is determined that the detailed description of a related known function or construction renders the scope of the present invention unnecessarily ambiguous, the detailed description thereof will be omitted. The below-described terms are defined in consideration of the functions in the present invention and the meanings of the terms should be interpreted based on the description of the present specification. The same reference numbers are used throughout this specification to refer to the same or like parts.

The present invention relates to a heat radiation apparatus and a lighting apparatus and, more particularly, to a heat radiation apparatus including a heat radiation module to increase a heat radiation effect without a fan and implementing a snow melting effect of an optical member, and a lighting apparatus.

The heat radiation apparatus according to the present invention is applicable to various lamp apparatuses such as a vehicle lighting apparatus, a home lighting apparatus and an industrial lighting apparatus. For example, when the heat radiation apparatus is applied to a vehicle lamp, the heat radiation apparatus is applicable to a headlight or a rear light. In addition, the heat radiation apparatus is applicable to currently available lighting apparatuses or all lighting apparatuses which may be implemented in the future according to technical development.

FIGS. 1 and 2 are views illustrating a heat radiation apparatus according to an embodiment of the present invention. FIG. 1 is a view showing the appearance of a heat radiation apparatus according to an embodiment of the present invention and FIG. 2 is a view showing a heat radiation module inserted into a housing of a heat radiation apparatus according to an embodiment of the present invention in detail.

The heat radiation apparatus according to the embodiment of the present invention will be described with reference to FIGS. 1 and 2.

As shown in FIG. 1, the heat radiation apparatus according to the embodiment of the present invention includes a heat transfer module 120 and a housing 130.

The heat transfer module 120 transfers heat generated in a light source module 110.

More specifically, the light source module 110 may be provided on the heat transfer module 120 and the heat transfer module 120 transfers heat generated in the light source module 110 to the housing 130.

A plurality of heat transfer modules 120 may be provided in the housing 130 to traverse the inside of the housing 130 and the light source modules 110 are spaced apart from each other. The light source module 110 includes a printed circuit board and a light emitting element mounted on the printed circuit board to emit light. The light emitting element may include a light emitting diode (LED).

The housing 130 includes a heat radiation module 135 as shown in FIG. 2. The heat radiation module 135 may be inserted into the housing 130.

More specifically, the heat radiation module 135 may be embedded in the wall of the housing 130 or may be attached to the wall of the housing 130.

The housing 130 may be made of a thermally conductive polymer material. When the thermally conductive polymer material is used as the material of the housing 130, the housing may be manufactured using a double injection molding method to obtain a high-strength structure while increasing a degree of freedom and decreasing cost.

According to the embodiment of the present invention, the housing 130 is made of the thermally conductive polymer material and thus is advantageous in terms of design, cost and strength. Since the heat radiation module 135 is inserted into the housing 130, a heat radiation effect can be maximized.

The heat radiation module 135 will now be described in detail. The heat radiation module 135 includes a first heat radiation portion having a bar shape and a second heat radiation portion connected to the first heat radiation portion and having a bar shape. A plurality of second heat radiation portions may be included and may be structurally configured in a rib shape. The first heat radiation portion and the second heat radiation portion are different from each other in terms of arrangement direction.

When the heat radiation module 135 including the first heat radiation portion and the second heat radiation portion is configured in a rib shape, a heat transfer path may be more efficiently formed in the housing 130 and a heat radiation region of the housing 130 may be variously designed as necessary.

When the heat radiation module 135 including the first heat radiation portion and the second heat radiation portion is configured in a rib shape, the heat radiation module 135 may be inserted into the housing 130 having the same shape as a conventional housing. Therefore, an additional space is not required in the structure of the heat radiation apparatus.

The heat radiation module 135 may be made of a metal material. The heat radiation module may include at least one of Al, Cu, Ag, Cr and Ni according to a required heat radiation degree.

The heat transfer module 120 may be made of Al. The heat transfer module 120 and the heat radiation module 135 may be coupled using a bolt or thermally conductive epoxy in order to minimize contact resistance between the heat transfer module 120 and the heat radiation module 135.

FIG. 3 is a view illustrating a heat radiation apparatus according to another embodiment of the present invention. The heat radiation apparatus further includes a heat sink.

The embodiment of FIG. 3 may include a light emitting module 110, a heat transfer module 120, a housing 130, and a heat radiation module 135, similarly to the embodiment of FIGS. 1 and 2.

In addition, in the embodiment of FIG. 3, a heat sink 125 provided on the heat transfer module 120 is further included.

More specifically, the heat sink 125 may be provided on a surface opposite to a surface, on which the light source module 110 is provided, of the heat transfer module 120, thereby providing an additional heat radiation function.

At this time, a plurality of heat sinks 125 may be provided to respectively correspond to the plurality of light source modules 110.

The heat sink 125 may be attached to the heat transfer module 120 as a separate component or may be formed integrally with the heat transfer module 120.

A lighting apparatus may include a lens (not shown) and a lens fixing unit 140 in addition to the heat radiation apparatus according to each of the embodiments of FIGS. 1 to 3.

The lens diffuses light from the light source module 110 and the lens fixing unit 140 fixes the lens. The lens fixing unit 140 may be fixed to the housing 13.

FIGS. 4 and 5 are views illustrating heat radiation performance of a heat sink according to an embodiment of the present invention. FIG. 4 shows heat radiation performance of a heat radiation apparatus of the prior art and FIG. 5 shows heat radiation performance of a heat radiation apparatus according to an embodiment of the present invention.

As shown in FIG. 4, in the heat radiation apparatus of the prior art, the highest temperature of the light source module is 133.9° C.

However, as shown in FIG. 5, in the heat radiation apparatus according to the embodiment of the present invention, the highest temperature of the light source module is 125.1° C., which is lower than that of the prior art of FIG. 4 by 8.8° C. Therefore, it can be seen that the heat radiation apparatus according to the embodiment of the present invention has excellent heat radiation performance.

In the heat radiation apparatus according to the embodiment of the present invention, from the temperature distribution of the surface of the housing shown in FIG. 5, it can be seen that a high-temperature region having a red color and a yellow color is widely spread.

This means that thermal conductivity is insufficient when only the housing is provided and heat is uniformly radiated by providing the heat radiation module to the housing.

As described above, according to the embodiment of the present invention, since heat generated in the light source module can be more efficiently radiated using the heat radiation module inserted into the housing, efficient cooling is possible without using a separate cooling apparatus such as a cooling fan.

The detailed embodiments have been described in the detailed description of the present invention. However, various modifications are possible without departing from the scope of the present invention. The technical idea of the present invention is not limited to the above-described embodiments of the present invention and is determined by the claims and equivalents thereof.

The invention claimed is:

1. A heat radiation apparatus comprising:

a heat transfer module for transferring heat generated in light source modules; and a housing including a heat radiation module for radiating heat delivered from the light source modules and the heat transfer module, wherein the heat radiation module includes:

a first heat radiation portion having a bar shape; and a second heat radiation portion connected to the first heat radiation portion and having a bar shape, wherein the housing includes an upper plate, and a first side plate and a second side plate extending downward from both ends of the upper plate, wherein a plurality of second heat radiation portion is included, wherein the second heat radiation portion is arranged in a direction different from an arrangement direction of the first heat radiation portion, wherein the first heat radiation portion includes a first surface disposed in contact with an inner wall surface of the upper plate of the housing, wherein the second heat radiation portion includes a first surface disposed in contact with the inner wall surface of the upper plate of the housing, wherein the first surface of the second heat radiation portion is arranged in a same planar direction as the first surface of the first heat radiation portion, and wherein the first heat radiation portion further includes a second surface disposed in contact with an inner wall surface of the first side plate of the housing, wherein the second head heat radiation portion further includes a second surface disposed in contact with an inner wall surface of the first side plate of the housing.

2. The heat radiation apparatus according to claim 1, wherein the housing is made of a thermally conductive polymer material.

3. The heat radiation apparatus according to claim 1, wherein the heat radiation module is made of a metal material.

4. The heat radiation apparatus according to claim 1, wherein the light source modules are provided on the heat transfer module, and wherein heat sinks provided on a surface opposite to a surface, on which the light source modules are provided, of the heat transfer module.

5. The heat radiation apparatus according to claim 4, wherein the heat sinks are provided to respectively correspond to the light source modules.

6. The heat radiation apparatus according to claim 1, wherein the heat transfer module is provided to traverse the inside of the housing.

7. The heat radiation apparatus according to claim 1, wherein a plurality of heat radiation modules is provided in the housing.

8. The heat radiation apparatus according to claim 1, wherein the first heat radiation portion further includes a third surface disposed in contact with an inner wall surface of the second side plate of the housing.

9. The heat radiation apparatus according to claim 1, wherein the first surface of the second heat radiation portion extends to form an acute angle from the first surface of the first heat radiation portion.

10. A lighting apparatus comprising:

a heat radiation apparatus including a heat transfer module for transferring heat generated in light source modules and a housing including a heat radiation module for radiating heat delivered from the light source modules and the heat transfer module;

a lens for diffusing light from the light source modules; and a lens fixing unit for fixing the lens for diffusing light from the light source modules, wherein the heat radiation module includes:

a first heat radiation portion having a bar shape; and a second heat radiation portion connected to the first heat radiation portion and having a bar shape, wherein the housing includes an upper plate, and a first side plate and a second side plate extending downward from both ends of the upper plate, wherein a plurality of second heat radiation portion is included, wherein the second heat radiation portion is arranged in a direction different from an arrangement direction of the first heat radiation portion, wherein the first heat radiation portion includes a first surface disposed in contact with an inner wall surface of the upper plate of the housing, wherein the second heat radiation portion includes a first surface disposed in contact with the inner wall surface of the upper plate of the housing, wherein the first surface of the second heat radiation portion is in a same planar direction as the first surface of the first heat radiation portion, and wherein the light source modules are provided on the heat transfer module, and wherein heat sinks are provided on a surface opposite to a surface, on which the light source modules are provided, of the heat transfer module.

11. The lighting apparatus according to claim 10, wherein the heat sinks are provided to respectively correspond to the light source modules.

* * * * *